US006427665B1

(12) United States Patent
Knoedl et al.

(10) Patent No.: US 6,427,665 B1
(45) Date of Patent: Aug. 6, 2002

(54) HIGH PRESSURE FUEL RESERVOIR

(75) Inventors: Helmut Knoedl, Marbach-Rielingshausen; Stefan Haug, Waldenbuch, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/869,918

(22) PCT Filed: Oct. 20, 2000

(86) PCT No.: PCT/DE00/03695

§ 371 (c)(1),
(2), (4) Date: Oct. 22, 2001

(87) PCT Pub. No.: WO01/34969

PCT Pub. Date: May 17, 2001

(30) Foreign Application Priority Data

Nov. 8, 1999 (DE) ..... 199 53 577

(51) Int. Cl.[7] ..... F02M 55/02
(52) U.S. Cl. ..... 123/456; 123/468

(58) Field of Search ..... 123/456, 468, 123/469, 470; 138/26

(56) References Cited

U.S. PATENT DOCUMENTS 5,979,945 A * 11/1999 Hitachi ..... 285/125.1
6,126,208 A * 10/2000 Asada et al. ..... 285/133.4
6,135,091 A * 10/2000 Itoh ..... 123/456

* cited by examiner

*Primary Examiner*—Thomas N. Moulis
(74) *Attorney, Agent, or Firm*—Ronald E. Greigg

(57) ABSTRACT

The invention relates to a high-pressure fuel reservoir for a common-rail fuel injection system of an internal combustion engine, having a tubular base body, which has a substantially circular-cylindrical interior disposed centrally with respect to the longitudinal axis of the tubular base body, which interior communicates with a plurality of connection openings. To enhance the high-pressure strength by simple provisions, the cross section of the tubular base body, in the portions in which the connection openings are disposed, is embodied in weakened form.

8 Claims, 1 Drawing Sheet

HIGH PRESSURE FUEL RESERVOIR

CROSS-REFERENCE TO RELATED APPLICATIONS

This application is a 35 USC 371 application of PCT/DE 00/03695 filed on Oct. 20, 2000.

BACKGROUND OF THE INVENTION

1. Field of the Invention

The invention relates to a high-pressure fuel reservoir for a common-rail fuel injection system of an internal combustion engine, having a tubular base body, which has a substantially circular-cylindrical interior disposed centrally with respect to the longitudinal axis of the tubular base body, which interior communicates with a plurality of connection openings.

2. Description of the Prior Art

In common rail-injection systems, a high-pressure pump, optionally with the aid of a feed pump, pumps the fuel to be injected out of a tank into the central high-pressure fuel reservoir, which is known as a common rail. From the rail, fuel lines lead to the individual injectors, which are assigned one to each of the engine cylinders. The injectors are triggered individually by the engine electronics as a function of the engine operating parameters, in order to inject fuel into the combustion chambers of the engine. By means of the high-pressure fuel reservoir, the pressure generation and the injection are decoupled from one another.

One conventional high-pressure fuel reservoir is described in German Patent Disclosure DE 195 48 611, to name one example. The known high-pressure fuel reservoir withstands pressures of up to about 1100 bar.

OBJECTS AND SUMMARY OF THE INVENTION

The primary object of the invention is to enhance the high-pressure strength of the known high-pressure fuel reservoir by simple provisions.

In a high-pressure fuel reservoir for a common-rail fuel injection system of an internal combustion engine, having a tubular base body, which has a substantially circular-cylindrical interior disposed centrally with respect to the longitudinal axis of the tubular base body, which interior communicates with a plurality of connection openings, this object is attained in that the cross section of the tubular base body, in the portions in which the connection openings are disposed, is embodied in weakened form. Within the context of the present invention, it has been found that in the region of the intersections between the connection openings and the tubular base body, under internal pressure, critical tensile stresses occur. By the intentional weakening of the tubular base body, the high-pressure strength of the high-pressure fuel reservoir of the invention is enhanced.

A particular embodiment of the invention is characterized in that the connection openings discharge substantially tangentially into the interior of the base body, and that one weakening of the tubular base body is provided in the region of each of the connection openings. In operation of the high-pressure fuel reservoir of the invention, the interior of the tubular base body expands under the high pressure prevailing there. As a result of the intentional weakening of the tubular base body, the circular cross section of the interior in the unloaded state is deformed into an ellipse, which is also called ovalizing of the diameter. A primary apex of the ellipse is located in the region of the respective connection opening. As a result, in the region of the intersection between the tubular base body and the connection opening, a compressive stress in the circumferential direction of the tubular base body is induced. This compressive stress compensates for part of the critical tensile stress. As a result, the stress in the regions of the intersections that are at high risk is reduced.

A further embodiment of the invention is characterized in that one further weakening of the tubular base body is provided opposite, as viewed in cross section, each of the connection openings. As a result, the above-described effect of ovalizing the interior of the tubular base body is still further reinforced. This leads to a further enhancement in the high-pressure strength-of-the-high-pressure fuel reservoir of the invention.

A further particular feature of the invention is characterized in that the connection openings discharge substantially radially into the interior of the base body, and that one further weakening of the tubular base body is provided opposite, as viewed in cross section, each of the connection openings. As a result, the above-described effect of ovalizing the interior of the tubular base body is attained even in the case of a radially disposed connection opening.

Still another particular feature of the invention is characterized in that the weakening of the tubular base body is formed by a lip angle, an undercut, or a key face. These types of cross-sectional weakening have the advantage that they can be produced in a simple way. As a result, even in conventional high-pressure fuel reservoirs, the high stresses in the intersection region that occur under internal pressure can be reduced.

BRIEF DESCRIPTION OF THE DRAWINGS

Further objects and advantages of the invention will become apparent from the ensuing description, taken in conjunction with the drawing, in which.

DESCRIPTION OF THE PREFERRED EMBODIMENT

Figure 1:
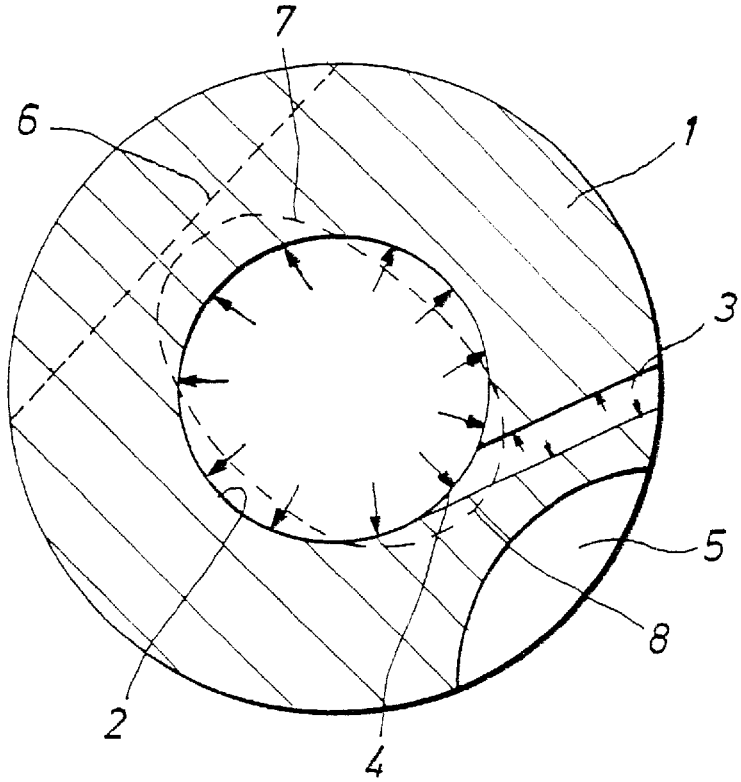
FIG. 1 is a first exemplary embodiment of the invention in cross section, with a tangential connection bore.

The first exemplary embodiment of a high-pressure fuel reservoir of the invention, shown in FIG. 1, includes a tubular base body 1. The tubular base body 1 takes the form of a hollow circular cylinder. A longitudinal bore 2 is recessed out of the interior of the tubular base body 1. The longitudinal bore 2 is disposed concentrically in the tubular base body 1 and forms the storage volume of the high-pressure fuel reservoir of the invention.

A connection bore 3 extends transversely to the longitudinal axis of the tubular base body and discharges at a tangent into the longitudinal bore 2. The bore intersection between the connection bore 3 and the longitudinal bore 2 is indicated at 4.

In the region of the connection bore 3, a recess 5 is provided in the outer jacket face of the tubular base body 1. The recess 5 is embodied in the form of a circular arc in cross section and extends longitudinally of the tubular base body 1 only in the region of the connection bore 3. A flat face is indicated at 6 opposite the recess 5.

Many arrows in the radial direction on the circumference of the longitudinal bore 2 represent the high pressure prevailing during operation in the interior of the tubular base body 1. The deformation of the tubular base body 1 under high pressure is indicated by an ellipse 7 drawn in dashed lines. Because of the cross-sectional weakenings at the points 5 and 6, additional compressive stresses occur in the circumferential direction at the critical point 8.

Figure 2:
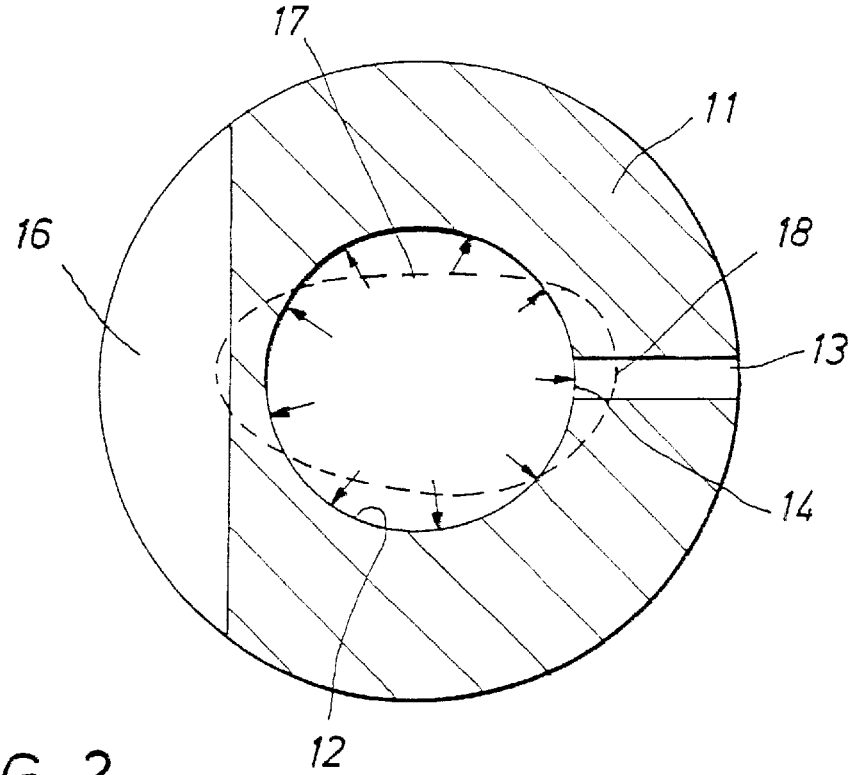
FIG. 2 is a second exemplary embodiment of the invention, with a radial connection bore.

The second exemplary embodiment, shown in FIG. 2, of a high-pressure fuel reservoi r of the invention includes a tubular base body 11. A longitudinal bore 12 is recessed out of the tubular base body 11. A connection bore 13 discharges radially into the longitudinal bore 12. The bore intersection between the connection bore 13 and the longitudinal bore 12 is indicated at 14.

The internal pressure occurring during operation is represented by many arrows in the radial direction on the circumference of the longitudinal bore 2. By means of a flat face 16 located opposite the connection bore 13, the tubular base body 11 deforms into the general shape of an ellipse 17 shown in dashed lines. As a result, the critical point 18 in the region of the bore intersection 14 is relieved.

By the provision according to the invention, the high stresses in the region of the bore intersections are reduced. By the cross-sectional weakenings, under load, ovalizing of the diameter is achieved. As a result, in the region of the intersections, compressive stresses in the circumferential direction are induced, and the critical tensile stresses are partly compensated for. This reduces the total stress at the bore intersections.

The invention can be disposed not only on high-pressure fuel reservoirs but also on injectors and unit fuel injector bodies.

The weakenings 5, 6; 16 of the tubular base body are embodied in the present invention on the outer jacket face of the tubular base body.

The foregoing relates to preferred exemplary embodiments of the invention, it being understood that other variants and embodiments thereof are possible within the spirit and scope of the invention, the latter being defined by the appended claims.

We claim:

1. A high-pressure fuel reservoir for a common-rail fuel injection system of an internal combustion engine, comprising a tubular base body (1; 11) having a substantially circular-cylindrical interior (2; 12) disposed centrally with respect to the longitudinal axis of said tubular base body, a plurality of connection openings (3; 13) communicating with said circular-cylindrical interior, and a reduced cross section of said tubular base body (1; 11), in the portions in which said connection openings (3; 13) are disposed providing a weakening of the tubular base body in this area.

2. The high-pressure fuel reservoir of claim 1, wherein said connection openings (3) discharge substantially tangentially into the interior of said base body (1), and wherein one weakening (5) of said tubular base body (1) is provided in the region of each of said connection openings (3).

3. The high-pressure fuel reservoir of claim 2, further comprising one further weakening (6) of the tubular base body (1) in the form of a cross section reduction opposite, as viewed in cross section, each of the connection openings (3).

4. The high-pressure fuel reservoir of claim 1, wherein said connection openings (13) discharge substantially radially into the interior of the base body (11), and wherein one further cross section reduction providing a weakening (16) of the tubular base body (11) is provided opposite, as viewed in cross section, each of the connection openings (13).

5. The high-pressure fuel reservoir of claim 1, wherein said reduced cross section providing said weakening (5, 6) of the tubular base body (1; 11) is formed by a lip angle, an undercut, or a key face.

6. The high-pressure fuel reservoir of claim 2, wherein said reduced cross section providing said weakening (5, 6) of the tubular base body (1; 11) is formed by a lip angle, an undercut, or a key face.

7. The high-pressure fuel reservoir of claim 3, wherein said reduced cross section providing said weakening (5, 6) of the tubular base body (1; 11) is formed by a lip angle, an undercut, or a key face.

8. The high-pressure fuel reservoir of claims 4, wherein said reduced cross section providing said weakening (5, 6) of the tubular base body (1; 11) is formed by a lip angle, an undercut, or a key face.

* * * * *